United States Patent [19]

Heimbrock

[11] Patent Number: 4,753,607

[45] Date of Patent: Jun. 28, 1988

[54] CLUSTER ASSEMBLY WITH ALIGNING BOSS

[75] Inventor: Henry H. Heimbrock, Cincinnati, Ohio

[73] Assignee: Standex International Corporation, Salem, N.H.

[21] Appl. No.: 7,605

[22] Filed: Jan. 28, 1987

[51] Int. Cl.[4] ..... H01R 13/631

[52] U.S. Cl. ..... 439/376; 439/685

[58] Field of Search ..... 339/65, 66 R, 66 M, 339/66 T, 191 M, 192 R, 192 RL; 439/246, 252, 374–376, 378–381, 682–691

[56] References Cited

U.S. PATENT DOCUMENTS

| | | | |
|---|---|---|---|
| 2,005,682 | 6/1935 | Pool | 339/66 M |
| 2,529,502 | 11/1950 | Kelly et al. | 339/66 T |
| 2,579,538 | 12/1951 | Bierce | 339/66 R |
| 3,753,193 | 8/1973 | Teagno et al. | 339/65 |
| 3,764,960 | 10/1973 | Heimbrock | 339/217 S |
| 3,850,496 | 11/1974 | Hague | 339/192 RL |
| 4,114,971 | 9/1978 | Heimbrock | 339/191 RL |

FOREIGN PATENT DOCUMENTS

| | | | |
|---|---|---|---|
| 0363388 | 12/1931 | United Kingdom | 439/683 |
| 581191 | 10/1946 | United Kingdom | 339/66 M |

*Primary Examiner*—Gil Weidenfeld
*Assistant Examiner*—Gary F. Paumen
*Attorney, Agent, or Firm*—Wood, Herron & Evans

[57] ABSTRACT

A cluster assembly wherein a block has three longitudinal passageways. Connector clips are inserted into those passageways. The block has transverse holes in a front wall providing a communication to the clips so that pins from a header can pass through the holes and be connected to the clips. One of those holes has a boss surrounding it to improve the assembly of the cluster assembly to the three-pin header.

4 Claims, 2 Drawing Sheets

CLUSTER ASSEMBLY WITH ALIGNING BOSS

This invention relates to a cluster assembly of the type used inside of a hermetically-sealed compressor.

The compressor with which the present invention is employed has a two-part housing that is ultimately welded together to provide the hermetically-sealed unit. Within the housing is a motor and a compressor driven by the motor. The motor must be connected to a source of electric power outside of the housing, and to this end, a three-prong header is mounted in the housing wall. The three-prong header, sometimes known as a glass-to-metal seal, has three pins secured in insulative glass supports, the supports being mounted in a steel unit which is in turn secured to the housing. The three pins provide the electrical communication from the inside of the housing to the outside.

To make the connection to the three pins, it has been conventional to employ a cluster assembly consisting of a block containing parallel passageways, three connector clips disposed in respective passageways and leads extending from the clips to the motor. See U.S. Pat. No. 3,764,960 for a representative cluster assembly.

In assembling the unit, the assembler slides the cluster assembly onto the three pins. This operation is usually done somewhat in the blind so that the assembler performs the operation partly by feel.

Certain problems have been encountered using the cluster assembly of the type shown in U.S. Pat. No. 3,764,960. The cluster block could be misaligned and thus pushed onto only two pins. The cluster assembly could be pushed on in a cockeyed fashion thereby giving rise to bad electrical contact. In manipulating the motor in the assembly process after the cluster assembly has been applied to the header, the lead wires might pull up on the end of the cluster block and cock the cluster assembly with respect to the three pins. This could result in an imperfect electrical connection.

Further, after assembly, the cluster block had two feet in contact with the skirt of the header. These feet were employed to maintain the cluster block flush with the header, that is, in a non-cocked position. Upon welding of the housing parts together, the heat of welding would tend to melt those contacting feet, causing plastic balls or flakes to separate from the cluster block and affect the operation of the compressor.

It has been an objective of the present invention to improve the structure of the cluster assembly to promote assembly, improve reliability and eliminate the possibility of degradation of the housing through the welding process.

The objects of the invention are attained, in part, by providing a single boss surrounding one of the pin-receiving holes on the front surface of the cluster assembly. In assembling, the assembler merely has to align that boss with one pin to start the assembly process. Thereafter, slight rotation brings the remaining two holes in alignment with their respective pins. At that point the operator can push the cluster assembly onto the header. Thus, the boss performs an aligning function. Further, the boss has a substantial dimension in the direction of the length of the pin. When it is applied to a pin, it provides a resistance to cocking so that when the cluster assembly is thereafter thrust "home" on the header, no cocking occurs.

By the same token, once applied, the cluster assembly cannot be cocked to a material extent because of the sleeve-like engagement of the boss with respect to one of the header pins.

Another feature of the invention has been to eliminate the feet at the corners of the cluster assembly. The boss has replaced their function of maintaining the cluster assembly in proper non-cocked alignment with respect to the pins. Additionally, the invention provides for stops within the cluster block that are engaged by the pins to limit the extent that the cluster assembly slides down on the pins when it is being applied. These stops thus maintain the block spaced from contact with the housing surface, thereby eliminating the possibility of degradation of the housing through the heat of welding.

The several features and objectives of the present invention will become more readily apparent from the following detailed description taken in conjunction with the accompanying drawings in which.

Figure 1:
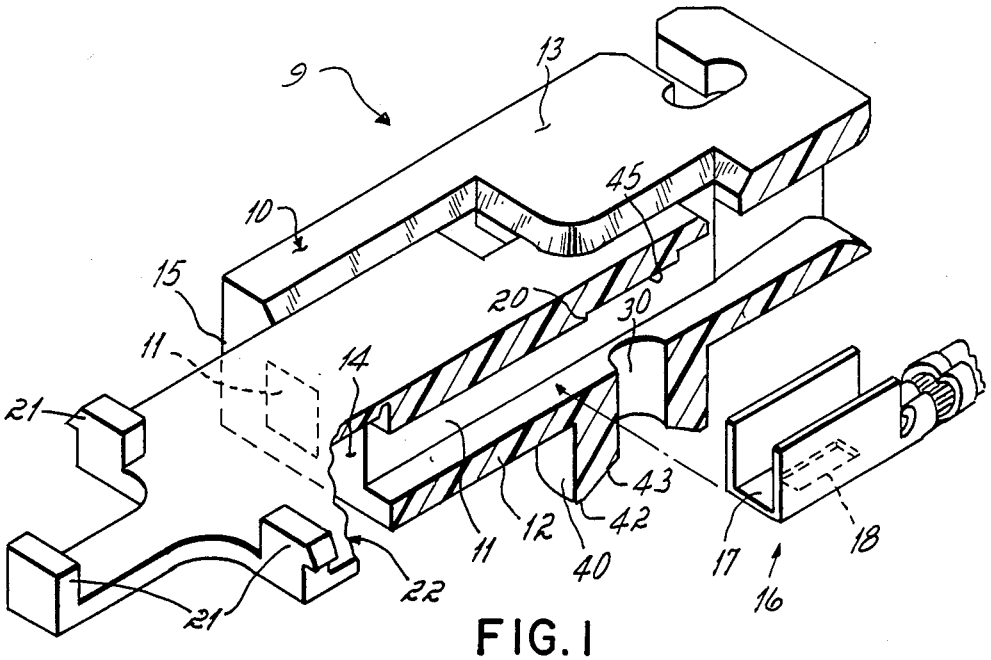
FIG. 1 is a disassembled perspective view, partly in section, showing the cluster assembly of the present invention.
Figure 2:
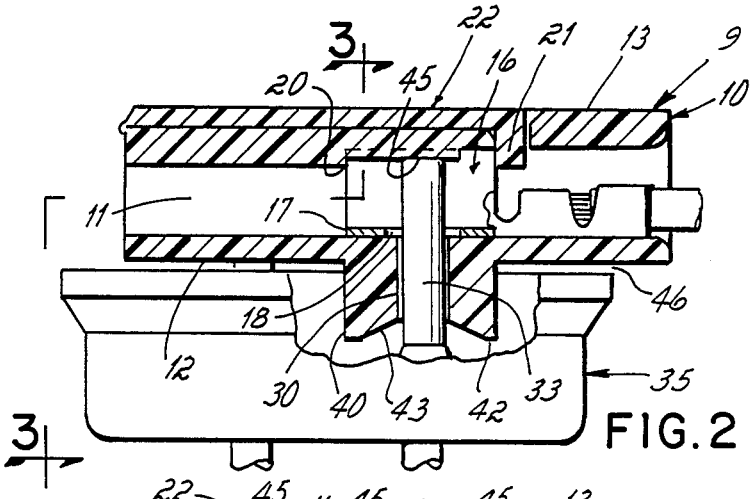
FIG. 2 is a longitudinal cross-sectional view showing the cluster assembly applied to a header.

The cluster assembly of the present invention is illustrated at 9 in FIG. 1. It has a cluster block 10 containing three parallel longitudinal passageways 11. The block has a front wall 12 and a back wall 13. The walls are separated by partitions 14 and side walls 15 which create the passageways 11. A clip 16 is disposed in each passageway, the clip in this form of the invention being channel-shaped having a bottom wall 17, the bottom wall 17 having an opening 18 through which a pin may pass to form an electrical connection. When in place in the longitudinal passageway, the clip abuts against an internal shoulder 20 at one end of the back wall and is captured by a detent 21 on the cap 22 which is pivoted to the block. When in position, the clip assumes the position illustrated in FIG. 2.

The front wall 12 has three holes 30 that are aligned with the openings 18 in the respective clips. The holes are adapted to receive pins 33 forming part of a header 35. When the pins pass through the holes 30 in the front wall of the cluster assembly, they engage the clip and are gripped by the edges of the opening 18 to form an electrical connection.

The illustrated form of the invention is principally used with pins of a 0.090 inch diameter. It can be used with the heavier duty header which has 0.125 inch diameter pins and uses a different type of clip. See, for example, U.S. Pat. No. 3,853,388.

In accordance with the invention, the central hole 30 has a circular boss 40 surrounding it. The boss creates the bore 30 that is about 0.010 to 0.015 greater diameter than the pin 33 which it receives. The boss has an end 42 formed with a frustoconical recess 43 which facilitates in the centering of the pin 33 and guiding it into the bore 30.

The bore associated with the boss is about 0.190 inch in length. This is a sufficient length to prevent any material cocking once a pin is fully received in the bore.

Figure 3:
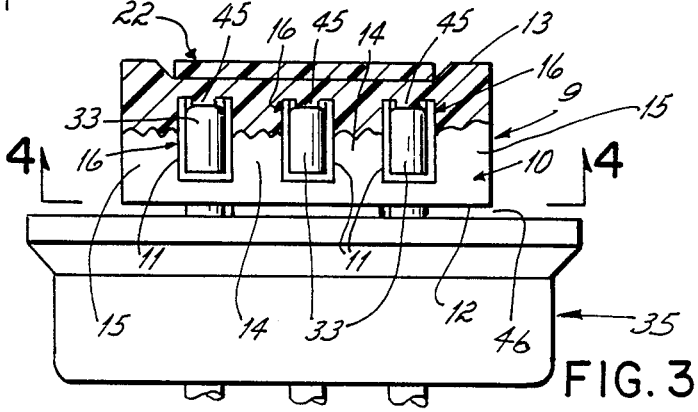
FIG. 3 is a cross-sectional view taken along lines 3—3 of FIG. 2.

Each passageway 11 has a stop 45 formed in the back wall and engageable by the end of a pin 33. The stop limits the extent of the application of the cluster assembly onto the pins thereby maintaining the plastic block spaced from the header as shown by the space 46 in FIGS. 2 and 3.

Figure 4:
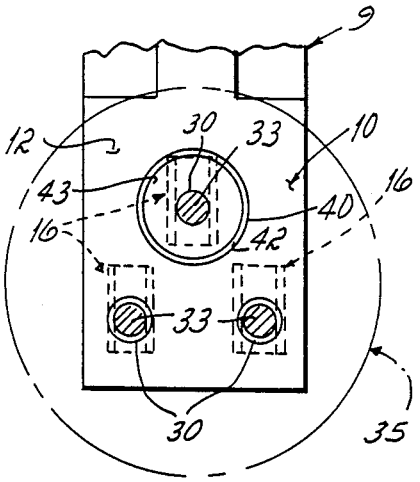
FIG. 4 is a cross-sectional view taken along lines 4—4 of FIG. 3.
Figure 4A:
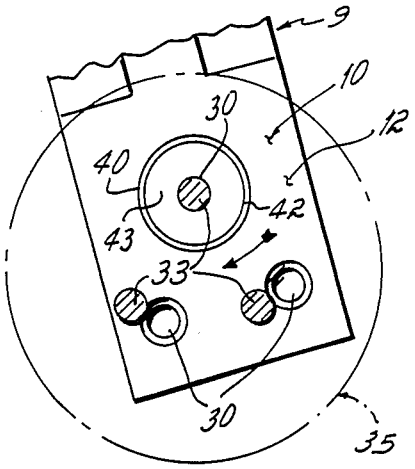
FIG. 4A is a view similar to FIG. 4 illustrating the assembly procedure.

In the assembly of the cluster assembly to a header, a pin 33 is received in the bore 30 as shown in FIG. 4A. The cluster assembly will usually be slightly misaligned with respect to the other two pins. As shown in FIG. 4A and FIG. 4, a slight rotation of the cluster assembly with respect to the pins provides the necessary alignment. Thereafer, the cluster assembly is thrust home to the position illustrated in FIGS. 2, 3 and 4. In this position, because of the cooperation of the boss with the pin, no material cocking of the cluster assembly is possible. Additionally, because of the engagement of the pins with the stop 45, the cluster assembly remains spaced from the header so that it cannot be degraded by the heat of welding the compressor housing together.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof.

I claim:

1. In a cluster assembly comprising a plastic block having front and back walls and longitudinally-extending partitions dividing said block into three parallel longitudinally-extending passageways, a pin-receiving clip disposed in each passageway, said block having three transverse holes through said front wall, each hole communicating with a respective passageway and being aligned with a clip, said holes being equiangularly spaced to receive, simultaneously, three pins from a three-in header, the improvement comprising, a boss formed on said front wall and surrounding one of said transverse holes, said boss having a pin-receiving bore aligned with the surrounded hole, said boss permitting partial introduction of a single pin and thereafter rotation of said block until said three pins are aligned with said three holes, whereupon said cluster assembly may be thrust all the way onto said pins.

2. A cluster assembly as in claim 1 in which said boss has a frustoconical recess in its end to guide a pin into its bore.

3. A cluster assembly as in claim 1 wherein said header has a metallic skirt surrounding said pins, said improvement further comprising, a stop in each said passageway engageable by each pin, the engagement of said stops by said pins limiting the extent of movement of said cluster assembly onto said pins and to space said cluster block from said skirt when said block is fully applied to said pins.

4. A cluster assembly as in claim 3 in which said clips are channel-shaped, having a bottom wall adjacent the front wall of said cluster block, and an opening in said clip bottom wall having one dimension less than the diameter of said pins, whereby sufficient contact is made between said pin and clip at any position of said clip around said pin.

* * * * *

UNITED STATES PATENT AND TRADEMARK OFFICE

CERTIFICATE OF CORRECTION

PATENT NO. : 4,753,607

DATED : June 28, 1988

INVENTOR(S) : Henry H. Heimbrock

It is certified that error appears in the above-identified patent and that said Letters Patent is hereby corrected as shown below:

Column 4, line 3, "three-in" should be changed to -- three-pin --.

Signed and Sealed this

Fifteenth Day of November, 1988

*Attest:*

DONALD J. QUIGG

*Attesting Officer*

*Commissioner of Patents and Trademarks*